US005967204A

United States Patent [19]

Ferris et al.

[11] Patent Number: 5,967,204

[45] Date of Patent: Oct. 19, 1999

[54] REFRIGERANT FLUID INJECTION APPARATUS

[76] Inventors: James E. Ferris, 15 High Mesa Palce, Richardson, Tex. 75080; William J. Quest, 5609 Ursula Ln., Dallas, Tex. 75229

[21] Appl. No.: 09/056,431

[22] Filed: Apr. 7, 1998

[51] Int. Cl.[6] ..... B65B 1/04

[52] U.S. Cl. ..... 141/383; 141/67; 141/69; 62/292

[58] Field of Search ..... 141/67, 373, 384, 141/386, 38, 98; 2/292; 222/406, 389

[56] References Cited

U.S. PATENT DOCUMENTS

| | | | |
|---|---|---|---|
| 1,140,177 | 5/1915 | McCauley . | |
| 2,679,654 | 6/1954 | Hosking | 7/1 |
| 2,689,675 | 9/1954 | Stirrup | 226/20.8 |
| 2,767,796 | 10/1956 | Roberts | 169/31 |
| 3,043,348 | 7/1962 | Wellsch | 141/38 |
| 3,367,545 | 2/1968 | Cook | 222/389 |
| 3,795,262 | 3/1974 | Post | 141/1 |
| 3,921,858 | 11/1975 | Bemm | 222/146 HE |
| 4,142,428 | 3/1979 | Vielman | 81/15.5 |
| 4,398,574 | 8/1983 | Moore | 141/1 |
| 4,555,295 | 11/1985 | Orikasa et al. | 156/349 |
| 4,612,798 | 9/1986 | Roberts | 73/40.7 |
| 4,653,550 | 3/1987 | Crowley | 141/18 |
| 4,798,233 | 1/1989 | Mooney | 141/38 |
| 5,064,098 | 11/1991 | Hutter, III et al. | 222/137 |
| 5,070,917 | 12/1991 | Ferris et al. | 141/38 |
| 5,080,132 | 1/1992 | Manz et al. | 62/292 |
| 5,333,467 | 8/1994 | Pearl, II et al. | 62/292 |

FOREIGN PATENT DOCUMENTS 854744 11/1960 United Kingdom .

OTHER PUBLICATIONS

EF Products, Inc., brochure, 2 pages, Mar. 11, 1998.
UView, brochure, 6 pages, Mar. 11, 1998.

*Primary Examiner*—Steven O. Douglas
*Attorney, Agent, or Firm*—Konneker & Smith, P.C.

[57] ABSTRACT

An injection device is operable to force a treatment fluid into a refrigerant circuit having an R-134a service fitting thereon and includes a tubular container in which the treatment fluid is disposed. The container has an outlet structure with a body section adapted to sealingly receive and open the service fitting, and a rotatable nut portion operative to deform the body section and releasably lock it onto the service fitting. A hollow plunger member is threaded into the container and may be (1) threadingly advanced into the container to force the treatment fluid outwardly therefrom into the refrigerant circuit, or (2) serve as a conduit through which a pressurized driving fluid may be forced into the container to drive the treatment fluid into the refrigerant circuit. Inlet and outlet check valve structures are incorporated into the device to prevent undesirable fluid backflow therethrough. The inlet check valve structure includes an annular elastomeric sleeve member that has a flat cross-sectional shape around its periphery, circumscribes a tubular outlet portion of the plunger member, and functions to block side wall outlet openings therein in a manner preventing fluid backflow therethrough, while at the same time being fluid pressure-expandable in a radial direction to permit fluid flow through the outlet openings in the desired operative direction.

17 Claims, 4 Drawing Sheets

REFRIGERANT FLUID INJECTION APPARATUS

BACKGROUND OF THE INVENTION

The present invention generally relates to apparatus for flowing fluids into enclosed spaces and, in a preferred embodiment thereof, more particularly relates to apparatus for flowing refrigerant fluid, such as a treatment oil, into an air conditioning system.

An embodiment of the invention illustrated and described in U.S. Pat. No. 5,070,917 to Ferris et al utilizes a source of pressurized refrigerant fluid to force a quantity of refrigerant treatment liquid, representatively a leak-inhibiting liquid, into an air conditioning refrigerant circuit from a tubular container in which the treatment liquid is sealingly stored. This apparatus was designed for use with refrigerant circuits which utilized R-12 refrigerant and had screw-threaded inlet and outlet connection fittings connected to hollow inlet and outlet members extending into opposite ends of the hollow, liquid-containing body portion of the apparatus.

Each of the inlet and outlet members had associated therewith a check valve structure serving to prevent undesirable treatment liquid backflow through the apparatus body portion from its outlet to its outlet. The check valve structure at each of the inlet and outlet members comprised an annular sidewall groove formed in the member, a pair of openings extending laterally through the groove into the hollow interior of the member, and an elastomeric O-ring member received in the annular groove and normally covering the lateral openings therein.

In a subsequently marketed version of this refrigerant liquid injection apparatus, the inlet member was reconfigured and modified in a manner permitting it to be threadingly advanced through the interior of the apparatus body in a manner permitting the user to mechanically force the treatment fluid out of the body as an alternative to using pressurized fluid flowed through the inlet member to force the treatment liquid outwardly from the body into the refrigerant circuit.

More recently manufactured refrigerant circuits are filled with R-134a refrigerant (which has replaced the previously utilized R-12 refrigerant) and have standardized R-134a service fittings with non-externally threaded configurations. Due to these changes in the service fitting configuration and the type of refrigerant used in modern R-134a air conditioning refrigerant circuits, the refrigerant treatment liquid injection apparatus shown in the aforementioned U.S. Pat. No. 5,070,917 (or as later modified as described above) cannot be conveniently utilized in conjunction with an R134a refrigerant circuit. Additionally, the previously described check valve structures have proven to provide certain manufacturing difficulties.

From the foregoing it can be seen that it would be desirable to provide a refrigerant fluid injection apparatus, of the general type described above, in which the apparatus was suitable for use with an R-134a refrigerant system and was provided with improved check valve structures. It is to these goals that the present invention is directed.

SUMMARY OF THE INVENTION

In carrying out principles of the present invention, in accordance with a preferred embodiment thereof, specially designed apparatus is provided for injecting fluid inwardly through a generally tubular service fitting into an enclosed space, the service fitting having an inlet end and an internal spring-loaded closure plunger. Representatively, the enclosed space is disposed within an air conditioning R-134a refrigerant circuit, and the service fitting is an R-134a refrigerant service fitting.

The fluid injection apparatus includes a container adapted to hold the fluid to be injected, and an outlet structure carried by the container and having a discharge passage through which the fluid may be forced outwardly from the container. The outlet structure has a hollow body configured to removably receive an axial portion of the service fitting, in a connected orientation, a resilient seal portion operative to sealingly engage the service fitting, and an opening member positioned to depress the service fitting plunger to permit fluid flow from the discharge passage inwardly through the service fitting.

An outlet check valve structure, representatively including a spring-loaded elastomeric check valve member, is operative to prevent fluid inflow through the discharge passage into the interior of the container. A drive structure is carried by the container and is useable to force the fluid therein outwardly through the discharge passage.

Preferably, the drive structure is sealingly threaded into the container and is threadingly advanceable therein to force the fluid outwardly from the container through the discharge passage and into the service fitting. An outwardly projecting end portion of the drive structure has a hexagonally cross-sectioned section to which a wrench device may be operatively connected to facilitate the forcing of the drive structure into the container.

In its illustrated preferred embodiment, the drive structure also has an interior flow passage through which pressurized driving fluid may be forced into the container to drive the original fluid therein outwardly from the container and through the service fitting in an alternative manner. To facilitate this alternate method of discharging the container fluid inwardly through the service fitting, an outer end portion of the drive structure has an external configuration similar to that of an R-134a refrigerant service fitting so that an R-134a quick coupler supply fitting can be conveniently connected to the drive structure to force pressurized refrigerant fluid therethrough into the container.

In accordance with a feature of the invention, an inner end of the drive structure has a tubular discharge portion through which the flow passage extends. A side wall opening extends through the discharge portion into the flow passage, and a specially designed inlet check valve structure is provided for preventing fluid inflow through the side wall opening into the flow passage. In its preferred embodiment, this inlet check valve structure includes an annular deformable sleeve, representatively of a suitable elastomeric material, which coaxially circumscribes the discharge portion and blocks the side wall opening therein. The sleeve has a generally flat cross-sectional shape around its periphery. Sufficient fluid pressure within the flow passage radially expands the sleeve to permit driving fluid outflow from the flow passage through the side wall opening.

According to another feature of the invention, the fluid injection device also includes a specially designed connection structure for releasably holding the service fitting, in its connected orientation, within the outlet structure. This connection structure includes a tightening member carried on the hollow outlet structure body and being movable relative thereto to tighten a portion of the body against the received service fitting portion in a manner removably retaining it in its connected orientation within the body.

Representatively, this connection structure includes a tightening nut member threaded onto the body, and the body has axial slits therein which form a circumferentially spaced plurality of axially extending body segments. The outer ends of these segments have tapered outer side surfaces which cooperate with a similarly tapered annular interior side surface portion on the nut member such that when the nut member is tightened onto the body it radially inwardly deflects the body segments into releasably locking engagement with the received service fitting. When the device is used in conjunction with an R-134a refrigerant service fitting, the body segments are radially inwardly deflected into releasably locking engagement with the annular external body flange of the service fitting.

DETAILED DESCRIPTION

Figure 1:
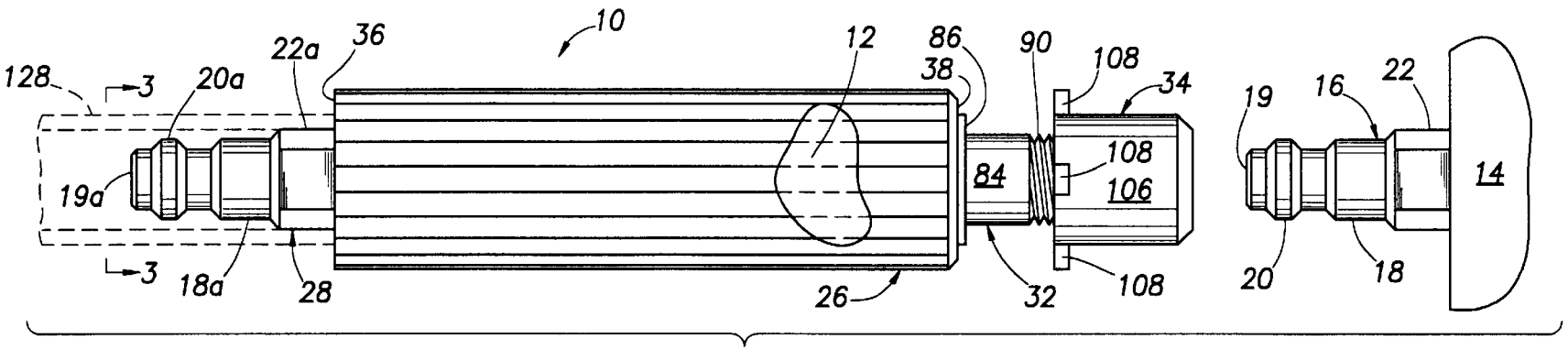
FIG. 1 is a side elevational view of a specially designed refrigerant fluid injection device embodying principles of the present invention and illustrating in phantom a deep socket wrench drivingly connected to an outer end fitting portion thereof.
Figure 2:
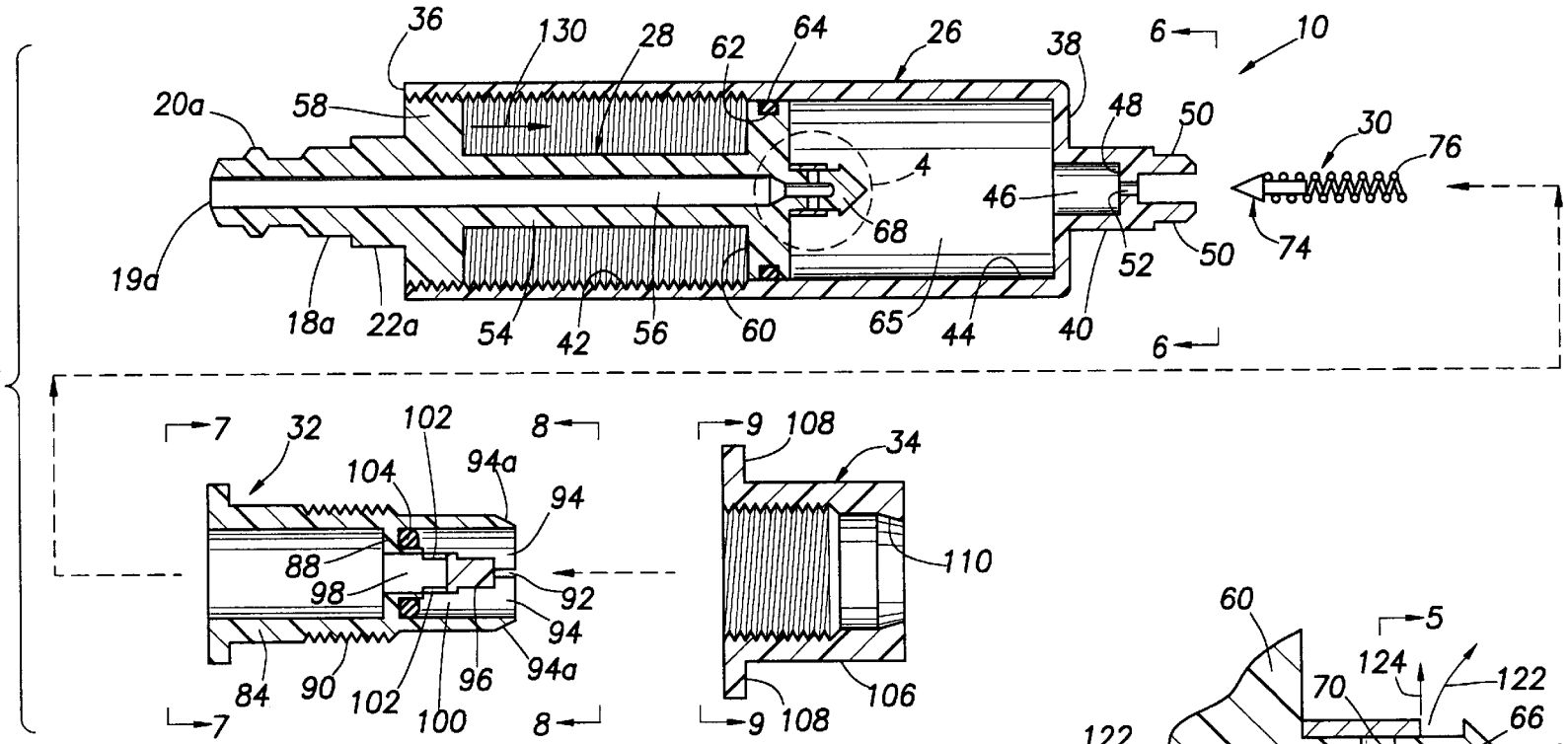
FIG. 2 is a partially exploded cross-sectional view through the fluid injection device.

Referring initially to FIGS. 1—2, the present invention provides a specially designed device 10 used to inject a refrigerant fluid, representatively lubricating oil 12, into an automotive air conditioning R-134a refrigerant circuit 14 through a service fitting 16 incorporated with the circuit 14 and communicating with its interior. The service fitting 16 has a Society of Automotive Engineering (SAE) specification R-134a configuration and includes a generally tubular body 18 with an open left or inlet end 19, an annular external side surface flange 20 positioned inwardly adjacent the inlet end 18, a hexagonally cross-sectioned inner end portion 22, and an internal, normally closed check valve structure including a spring-loaded, axially depressible plunger portion 24 (see FIG. 10).

With the exception of the subsequently described metal valve spring and elastomeric seals and check valve members therein, the refrigerant fluid injection device 10 is representatively formed entirely from a suitable injection molded plastic material and, as cross-sectionally illustrated in FIG. 2, includes an externally ribbed hollow tubular container 26; a drive structure in the form of a plunger member 28; an outlet check valve structure 30; a connector member 32 serving as an outlet structure; and a tightening nut member 34.

Figure 6:
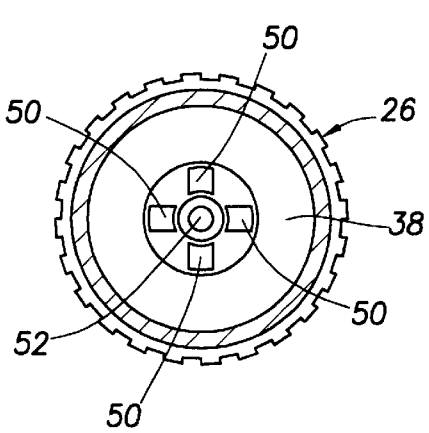
FIG. 6 is a front end view of the body portion of the device taken along line 6—6 of FIG. 2.
Figure 3:
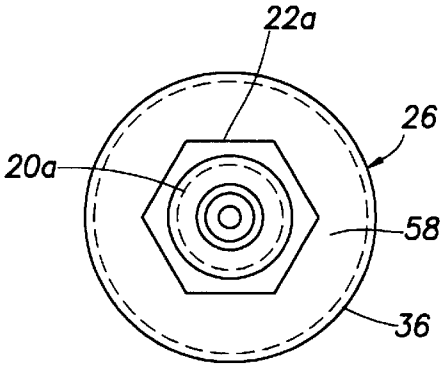
FIG. 3 is an inlet end view of the assembled device taken along line 3—3 of FIG. 1.

The container 26 has an open left or inlet end 36, a right end wall 38 outwardly from which a reduced diameter hollow tubular outlet section 40 axially projects, and internal threads 42 formed on a left end portion of the interior side surface of the container 26. Extending between the threaded interior side surface portion 42 and the right end wall 38 is an unthreaded interior side surface portion 44 of the container 26. An axial passage 46 extends rightwardly through the end wall 38 into the interior of the outlet section to an outer or right end wall 48 thereof. As shown in FIGS. 2 and 6, four circumferentially spaced spring guide posts 50 extend outwardly from the right end wall 48 and are positioned around a central circular opening 52 formed in the end wall 48 and functioning, as later described herein, as an outlet opening from the interior of the container 26 and as a valve seat.

The plunger member 28 has a hollow tubular body 54 through which a central fluid flow passage 56 axially extends. A left end portion 54*a* of the body 54 has an external configuration essentially identical to that of the previously described R-134a service fitting 16, having a tubular body 18*a*, an open inlet end 19*a*, an annular exterior side surface flange 20*a*, and a hexagonally cross-sectioned inner end portion 22*a*. An externally threaded annular flange 58 is formed on the body 54, just to the right of its end portion 54*a* and is threaded into a left end portion of the container 26 as best illustrated in FIG. 2. At the right end of the body 54 is an annular external flange 60 having an annular groove 62 formed in its periphery. The groove 62 receives an elastomeric O-ring seal member 64 which slidingly and sealingly engages the unthreaded interior side surface portion 44 of the container 26. As can be seen in FIG. 2, a chamber 65 for holding the lubricating oil 12 is formed within the container 26 between the flange 60 and the container end wall 38.

Figure 4:
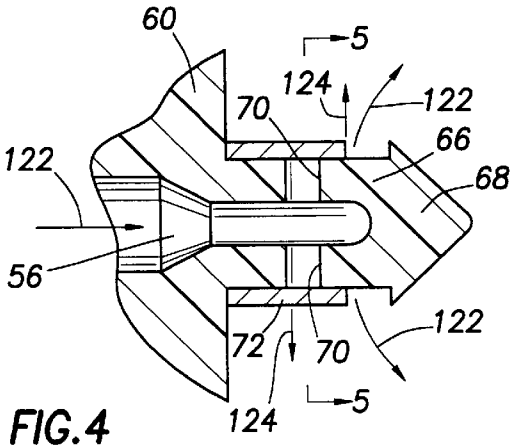
FIG. 4 is an enlarged scale cross-sectional detail view of the dashed circle area "4" in FIG. 2.
Figure 5:
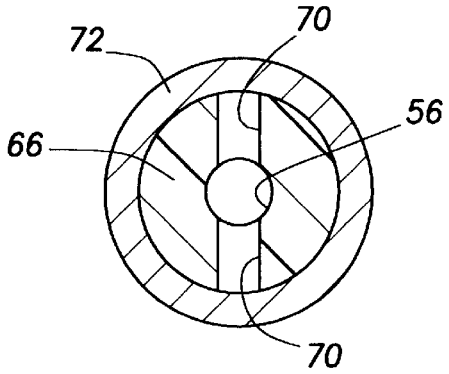
FIG. 5 is a cross-sectional view of an inlet check valve portion of the device taken along line 5—5 of FIG. 3.
Figure 7:
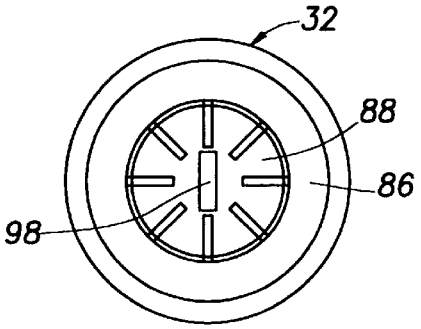
FIG. 7 is a rear end view of a connector portion of the device taken along line 7—7 of FIG. 2.
Figure 8:
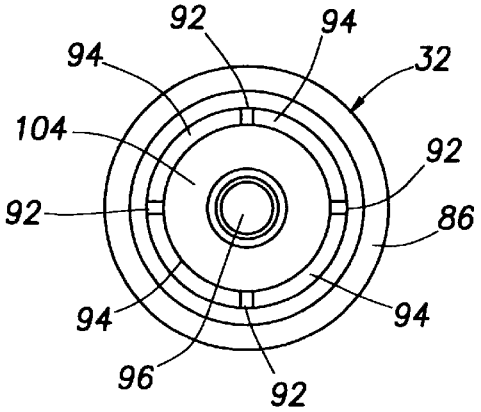
FIG. 8 is a front end view of the connector portion taken along line 8—8 of FIG. 2.
Figure 9:
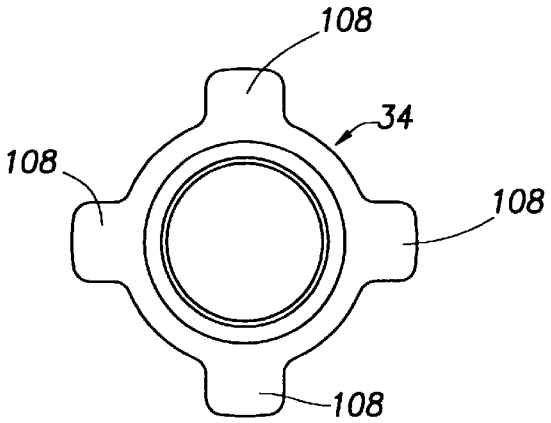
FIG. 9 is an enlarged scale rear end view of a nut portion of the device taken along line 9—9 Of FIG. 2.

Referring now to FIGS. 2, 4 and 5, the axial body passage 56 necks down as it rightwardly passes through the annular flange 60 and extends into a reduced diameter tubular projection 66 extending rightwardly from the flange 60 and having a conical outer end portion 68. A diametrically opposite pair of circular outlet openings 70 extend from the fluid flow passage 56 laterally outwardly through the tubular projection 66 and are covered by an annular elastomeric check valve sleeve member 72 that outwardly circumscribes the flat annular outer side surface of the tubular projection 66.

Figure 10:
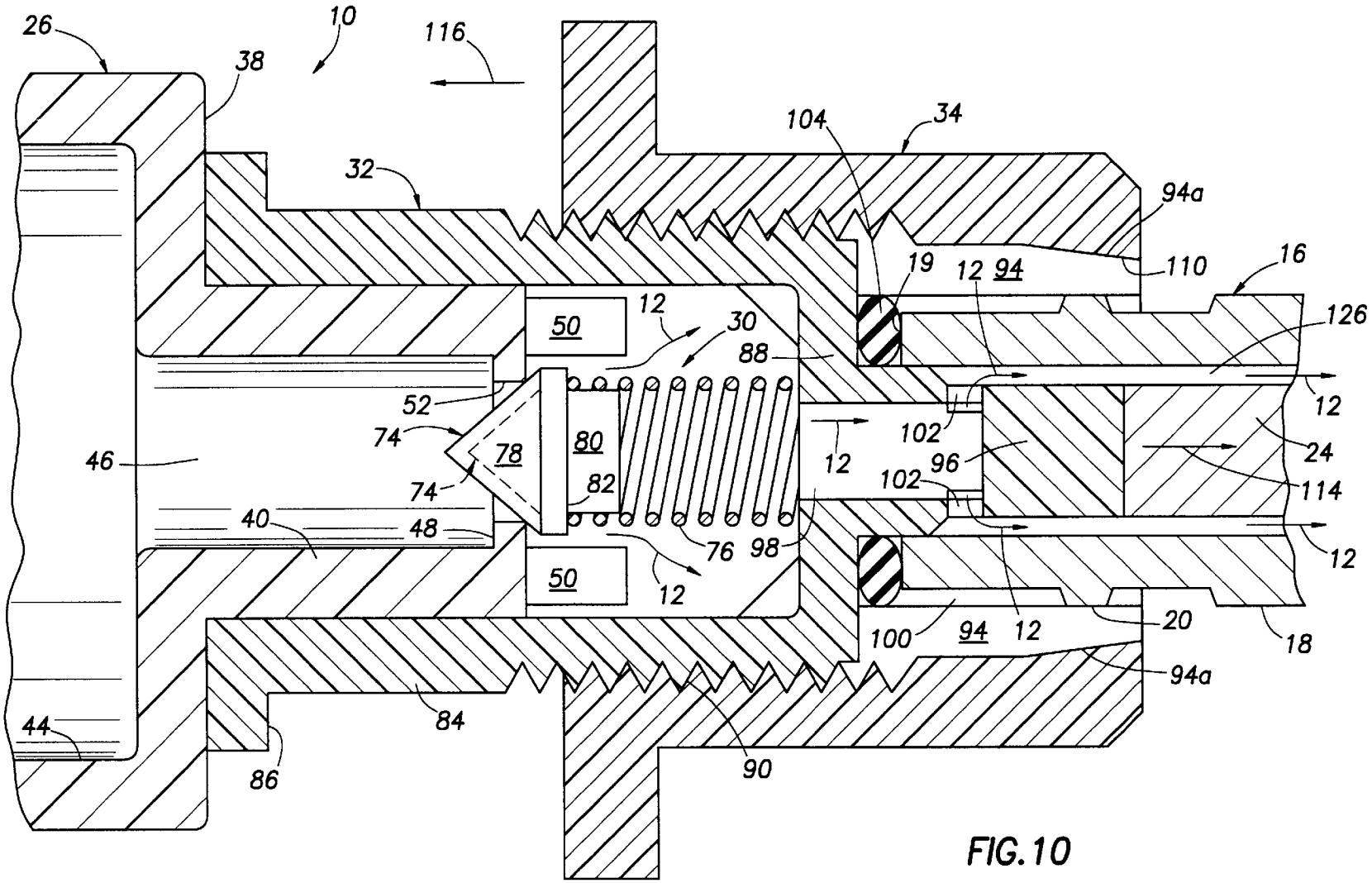
FIG. 10 is an enlarged scale cross-sectional view, partly in elevation, through an outlet end portion of the fluid injection device in its assembled state.

Turning now to FIGS. 2 and 10, the outlet check valve structure 30 includes an elastomeric valve member 74 and an elongated coiled metal compression spring 76. Valve member 74 has a conical head portion 78 from the flat side of which a cylindrical body portion 80 centrally projects. At the juncture of the head and body portions 78,80 an annular ledge 82 is defined. A left end portion of the spring 76 circumscribes the body 80, with the left end of the spring 76 bearing against the ledge 82.

The connector member 32 (see FIGS. 1, 2, 7 and 8) has a hollow tubular body 84 having, on its left end, a radially enlarged annular external flange 86. A circular interior wall 88 is disposed within a longitudinally intermediate portion of the body 84 just to the right of an externally threaded portion 90. The section of the body 84 extending rightwardly beyond the interior wall 88 has four circumferentially spaced axial slits 92 formed therein and defining therebetween four circumferentially spaced axially extending external wall portions 94 that may be resiliently deflected radially inwardly. For a purpose later described herein, outer end sections of the external wall portions 94 have outer side surfaces 94*a* which are rightwardly and radially inwardly tapered.

A cylindrical valve opening portion 96 of the connector member 32 projects rightwardly from a central portion of the interior wall 88 through a central portion of the body 84 circumscribed by the external wall portions 94. A flow passage 98 centrally extends through a left end of the valve opening portion 96 into the interior of the body 84 to the left of the interior wall 88, and opens outwardly into the annulus 100 between the valve opening portion 96 and the external wall portions 94 via a diametrically opposed pair of side wall discharge openings 102 formed in the valve opening portion 96. For purposes later described herein, an annular elastomeric O-ring seal member 104 circumscribes the valve opening portion 96 at its juncture with the interior wall 88.

With reference now to FIGS. 1, 2, 9 and 10, the nut member 34 has a hollow cylindrical body 106, four circumferentially spaced, radially outwardly projecting tabs 108 at its left end, and an internally threaded portion 110 extending inwardly from its left end. At the right end of the nut member 34 an annular interior surface portion 112 is rightwardly and radially inwardly tapered.

The refrigerant fluid injection device 10 is assembled by placing the valve member portion 74 of the outlet check valve structure 30 into the valve seat 52 between the spring guides 50 (see FIG. 10), placing the connector member 32 leftwardly over the outlet section 40 to position the left end flange 86 of the connector member 32 against the end wall 38 of the container 26 and compress the valve spring 76 between the valve body annular ledge 82 and the interior wall 88 of the tubular outlet section 40 of the connector member, and then sonically welding the flange 86 to the container end wall 38 to fixedly secure the connector member 32 on the tubular outlet section 40 of the container 26 as shown in FIG. 10. The unthreaded interior portion of the container 26 is then filled with the oil 12 (or other fluid to be subsequently injected into the refrigerant circuit 14), and the plunger member 28 is operatively screwed into the left end of the container 26 as cross-sectionally illustrated in FIG. 2.

To use the device 10 to inject the oil 12 into the refrigerant circuit 14 via its service fitting 16, the nut 34 is loosened on the connector member 32, and the nut member 34 is rightly pushed over the left end of the service fitting 16 as shown in FIG. 10 in a manner causing the open left end 19 of the service fitting 16 to compress the O-ring seal 104 and the valve opening portion 96 of the connector member 32 to engage and rightwardly depress the service fitting plunger 24, as indicated by the arrow 114 in FIG. 10, thereby opening the service fitting 16 which is sealingly engaged with the injection device 10 by means of the compressed O-ring seal member 104.

With the service fitting 16 sealed to the device 10 and held open in this manner, the nut member 34 is threadingly advanced leftwardly along the connector member 32, as indicated by the arrow 116 in FIG. 10. This leftward movement of the nut member 34 along the connector member 32 causes the sloping annular interior surface portion 110, by virtue of its engagement with the similarly sloped surface portions 94*a* of the wall portions 94 of the connector member, to cam the wall portions 94 radially inwardly into locking engagement with the flange portion 20 of the service fitting 16, thereby releasably locking the service fitting 16 to the device 10 as shown in FIG. 10.

After the refrigerant fluid injection device 10 has been locked to the service fitting 16 in this manner, the oil 12 may be injected into the circuit 14 via the now opened service fitting 16 in one of two ways.

Figure 1A:
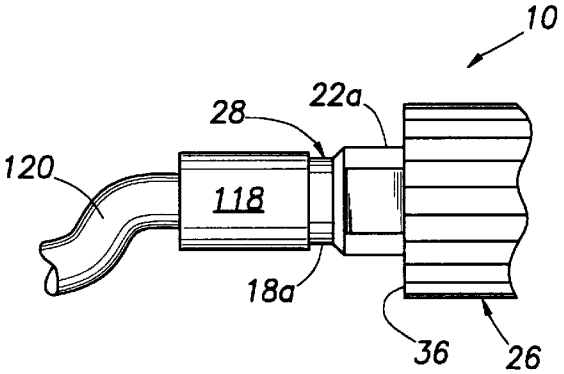
FIG. 1A is a side elevational view of an outer end portion of the device with a conventional R-134a quick connect coupler fitting operatively connected thereto.

First, as shown in FIG. 1A, a standard R-134a quick coupler fitting 118 at the discharge end of an R-134a refrigerant supply line 120 may be snapped onto the left end of the plunger member 28 and pressurized R-134a refrigerant flowed through the line 120 into the plunger flow passage 56. The pressurized refrigerant fluid 122 entering the passage 56 (see FIG. 4) radially expands the resilient elastomeric check valve sleeve member 72 (as indicated by the arrows 124 in FIG. 4 and allows the pressurized refrigerant fluid 122 to enter and pressurize the chamber 65 (see FIG. 2) in which the oil 12 is disposed.

This refrigerant fluid-created pressurization of the chamber 65 drives the outlet check valve member 74 rightwardly off its seat 52 to its dotted line FIG. 10 position, against the leftward resilient biasing force of the spring 76, to thereby force the oil 12 sequentially through the valve seat opening 52, the flow passage 98, the side wall discharge openings 102 in the valve opening portion 96 of the connector member, and through the annulus 126 between the service fitting plunger 24 and the body of the service fitting 16 into the refrigerant circuit. After all of the oil 12 (or other refrigerant treatment fluid) disposed in the container 26 is forced into the refrigerant circuit 14, the flow of pressurized R-134a refrigerant fluid 122 can be maintained to additionally inject a desired quantity of R-134a refrigerant fluid through the device 10 into the circuit 14 if desired.

An alternate method of using the device 10 to inject the treatment oil 12 into the refrigerant circuit 14 through the service fitting 16 is to drivingly attach the body 128 of a deep socket wrench (shown in phantom in FIG. 1) to the left end hex portion 22*a* of the plunger member 28 and then turn the attached wrench to threadingly advance the plunger member 28 into the interior of the container 26 as indicated by the arrow 130 in FIG. 2. This causes the rightwardly advancing plunger flange 60 to act as a piston and increase the pressure within the oil-containing chamber 65. The pressure increase in chamber 65 opens the outlet valve member 74 to its dotted line FIG. 10 position to permit the oil 12 to be forced into the circuit 14 as previously described and as indicated by the arrows 12 in FIG. 10. During this plunger-driven discharge of the oil 12 from the chamber 65, the annular elastomeric check valve band 72 (see FIG. 4) blocks the outlet openings 70 to prevent backflow of the oil 12 therethrough. In a similar manner, the outlet check valve member 74 (see FIG. 10) prevents leftward fluid backflow through the valve seat opening 52.

As can readily be seen from the foregoing, the refrigerant fluid injection device 10 is of a simple and relatively inexpensive construction, and is quite easy to use in either of the described alternative manners. The uniquely configured inlet check valve structure, with the flat annular elastomeric band 72 used as a valve member and positioned against a correspondingly flat external side surface of the tubular projection 66 (see FIGS. 4 and 5) is desirably easier to manufacture than the corresponding O-ring and groove-based inlet check valve structure illustrated and described in the aforementioned U.S. Pat. No. 5,070,917.

Additionally, the use of the specially designed service fitting connection structure at the outlet end of the device 10 provides for quick, easy and reliable connection to the R-134a service fitting without the more expensive conventional requirement of providing an R-134a quick coupling fitting to effect this connection. Instead, the present invention economically provides a simple molded plastic connection structure which lockingly clamps the fluid injection device onto the service fitting flange 20 as illustrated in FIG. 10

As previously mentioned, while the device 10 has been representatively illustrated and described herein as being utilized to inject oil 12 into the refrigerant circuit 14, it is by no means limited to this application. It could, for example, be utilized to inject a variety of other types of fluids (i.e., both liquids and gases) into the circuit 14 as well into other types of enclosed spaces in other types of applications.

The foregoing detailed description is to be clearly understood as being given by way of illustration and example only, the spirit and scope of the present invention being limited solely by the appended claims.

What is claimed is:

1. Apparatus for injecting a fluid inwardly through a generally tubular service fitting into an enclosed space, said service fitting having an inlet end and an internal spring-loaded closure plunger, said apparatus comprising:

a container adapted to hold the fluid;

an outlet structure carried by said container and having a discharge passage through which the fluid may be forced outwardly from said container, said outlet structure having a hollow body configured to removably receive an axial portion of the service fitting, in a connected orientation, a resilient seal portion operative to sealingly engage the service fitting, and an opening member positioned to depress the plunger to permit fluid flow from said discharge passage inwardly through the service fitting:

an outlet check valve structure operative to prevent fluid inflow through said discharge passage and into the interior of said container;

a drive structure carried by said container and useable to force the fluid therein outwardly through said discharge passage; and a tightening member carried on said outlet structure body and being movable relative thereto to tighten a portion of said body against the received service fitting portion in a manner removably retaining it in said connected orientation within said body, said hollow outlet structure body having a generally tubular shape and axial slits disposed therein and forming a circumferentially spaced plurality of body sections, and said tightening member being a nut member threaded onto said body and being threadingly advanceable therealong to radially deform said body sections inwardly against the received service fitting.

2. The apparatus of claim 1 wherein:

said enclosed space is disposed within a refrigerant circuit, said service fitting is an R-134a refrigerant service fitting and has an annular external side wall flange thereon, and said tightening member is operative to tighten said portion of said body against said annular external side flange.

3. The apparatus of claim 1 wherein:

said nut member and said body sections have cooperatively engageable cam surfaces disposed thereon and operative to facilitate the radial deformation of said body sections inwardly against the received service fitting in response to threadingly advancing said nut member along said body.

4. The apparatus of claim 1 wherein:

said outlet check valve structure includes a spring-loaded check valve member operatively disposed within said discharge passage.

5. The apparatus of claim 1 wherein:

said drive structure is threaded into said container and threadingly advanceable therein to force the fluid outwardly through said discharge passage.

6. The apparatus of claim 5 wherein:

said drive structure has an outer end section with a hexagonally cross-sectioned portion operatively engageable by a wrench device to facilitate the driven rotation of said drive structure to threadingly advance it into the interior of said container.

7. The apparatus of claim 1 wherein:

said drive structure is sealingly disposed within said container and has a flow passage extending therethrough through which pressurized driving fluid may be forced into the container to discharge the original fluid therein outwardly through said discharge passage.

8. The apparatus of claim 7 wherein:

said drive structure has an inlet fitting portion externally configured similarly to an R-134a refrigerant service fitting and to which an R-134a quick coupler fitting may be operatively attached.

9. The apparatus of claim 7 wherein:

said drive structure has a tubular discharge portion disposed within said container and having a side wall opening communicated with said flow passage, and said apparatus further comprises an inlet check valve structure operative to prevent fluid inflow through said side wall opening into said flow passage.

10. The apparatus of claim 7 wherein:

said inlet check valve structure includes an annular, deformable band member coaxially circumscribing said tubular discharge portion and covering said side wall opening therein, said band member having a generally flat cross-sectional shape around its periphery.

11. The apparatus of claim 10 wherein:

said band member is of an elastomeric material.

12. The apparatus of claim 1 wherein:

said resilient seal portion is operative to be deformed by said inlet end of the received service fitting.

13. Apparatus for injecting a fluid inwardly through a generally tubular service fitting into an enclosed space, said service fitting having an inlet end and an internal spring-loaded closure plunger, said apparatus comprising:

a container adapter to hold the fluid;

an outlet structure carried by said container and having a discharge passage through which the fluid may be forced outwardly from said container, said outlet structure having a hollow body configured to removably receive an axial portion of the service fitting, in a connected orientation, a resilient seal portion operative to sealingly engage the service fitting, and an opening member positioned to depress the plunger to permit fluid flow from said discharge passage inwardly through the service fitting, said hollow outlet structure body having a generally tubular shape and axial slits disposed therein and forming a circumferentially spaced series of body sections;

a holding structure associated with said outlet structure and operative to releasably hold the service fitting, in its connected orientation, within said outlet structure, said holding structure including a tightening member threaded onto said outlet structure body and being threadingly advanceable therealong to radially deform said body sections inwardly against the received service fitting;

an outlet check valve structure operative to prevent fluid inflow through said discharge passage and into the interior of said container;

a drive structure carried by said container and useable to force the fluid therein outwardly through said discharge passage, said drive structure having an internal flow passage through which a pressurized driving fluid may be flowed into the container, and a tubular discharge portion having a side wall opening communicated with said flow passage; and an inlet check valve structure operative to prevent fluid inflow through said side wall opening into said flow passage, said inlet check valve structure including an annular, deformable band member coaxially circumscribing said tubular discharge portion and covering said side wall opening therein, said band member having a generally flat cross-sectional shape around its periphery.

14. The apparatus of claim 13 wherein:

said band member is of an elastomeric material.

15. The apparatus of claim 13 wherein:

said drive structure is threaded into said container and threadingly advanceable therein to force the fluid outwardly through said discharge passage.

16. The apparatus of claim 15 wherein:

said drive structure has an outer end section with a hexagonally cross-sectioned portion operatively engageable by a wrench device to facilitate the driven rotation of said drive structure to threadingly advance it into the interior of said container.

17. The apparatus of claim 16 wherein:

said outer end section of said drive structure is externally configured similarly to an R-134a refrigerant service fitting.

* * * * *